US007029047B2

(12) United States Patent
Wooten et al.

(10) Patent No.: US 7,029,047 B2
(45) **Date of Patent: *Apr. 18, 2006**

(54) INEXPENSIVE COMPACT GRAPPLING HOOK

(75) Inventors: Donald W. Wooten, Dallas, TX (US); Brian W. Wooten, Arlington, TX (US)

(73) Assignee: Tactical and Rescue Gear, Ltd., Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/068,610

(22) Filed: Feb. 28, 2005

(65) Prior Publication Data

US 2005/0146148 A1 Jul. 7, 2005

Related U.S. Application Data

(63) Continuation of application No. 10/295,311, filed on Nov. 14, 2002, now Pat. No. 6,860,535.

(60) Provisional application No. 60/360,300, filed on Feb. 26, 2002.

(51) Int. Cl.
*B66C 1/22* (2006.01)

(52) U.S. Cl. ..... 294/82.1; 294/1.1

(58) Field of Classification Search ..... 294/1.1, 294/2, 82.1, 66.1; 114/294, 301; 43/43.16, 43/44.82, 44.92; 7/118, 123

See application file for complete search history.

(56) References Cited

U.S. PATENT DOCUMENTS

| | | | | |
|---|---|---|---|---|
| 3,485,199 | A | 12/1969 | Schuman | |
| 4,108,484 | A | 8/1978 | Malroit | |
| 6,079,761 | A | 6/2000 | Sadeck | |
| 6,126,217 | A | 10/2000 | Guadiana et al. | |
| 6,860,535 | B1 * | 3/2005 | Wooten et al. | 294/82.1 |

* cited by examiner

*Primary Examiner*—Dean J. Kramer
(74) *Attorney, Agent, or Firm*—Dunlap, Codding & Rogers, P.C.

(57) ABSTRACT

A grappling hook blank for forming a grappling hook having a shaft, a plurality of arms and a connecting member. The grappling hook blank includes a piece of material having a shaft portion, a plurality of arm portions, and a connecting member portion. The shaft portion forms the shaft of the grappling hook. The plurality of arm portions forms each of the plurality of arms of the grappling hook. Each of the plurality of arms of the grappling hook is formed by moving each of the plurality of arm portions outwardly from the grappling hook blank. The connecting member portion connects the shaft portion and the plurality of arm portions wherein the connecting member portion forms a connecting member of the grappling hook such that the connecting member of the grappling hook connects the shaft and the plurality of arms of the grappling hook.

3 Claims, 3 Drawing Sheets

INEXPENSIVE COMPACT GRAPPLING HOOK

CROSS REFERENCE TO RELATED APPLICATIONS

The present patent application is a continuation of U.S. Ser. No. 10/295,311, filed Nov. 14, 2002, which claims priority to the provisional patent application identified by U.S. Ser. No. 60/360,300, filed on Feb. 26, 2002. Each of the above-referenced patent applications is incorporated herein by reference for all purposes.

STATEMENT REGARDING FEDERALLY SPONSORED RESEARCH OR DEVELOPMENT

Not Applicable.

DETAILED DESCRIPTION OF THE INVENTION

Figure 1:
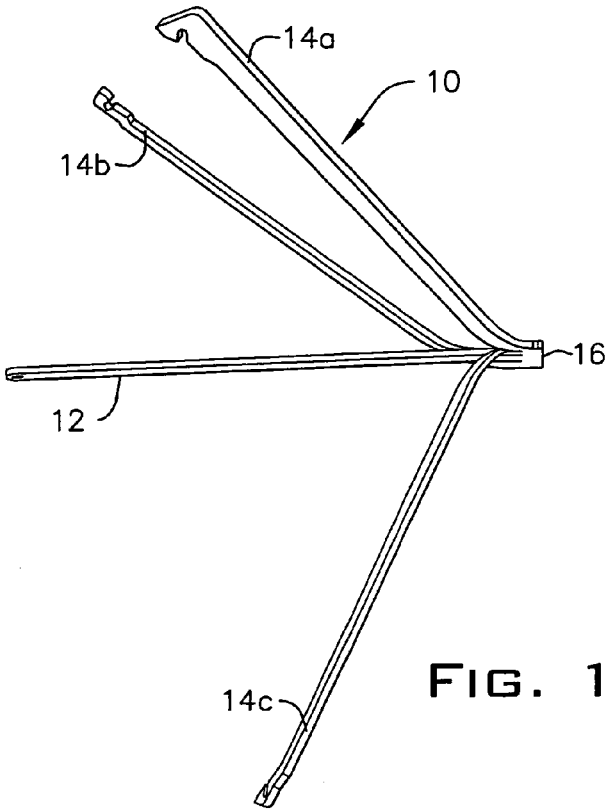
FIG. 1 is a perspective view of a grappling hook constructed in accordance with the present invention.
Figure 3:
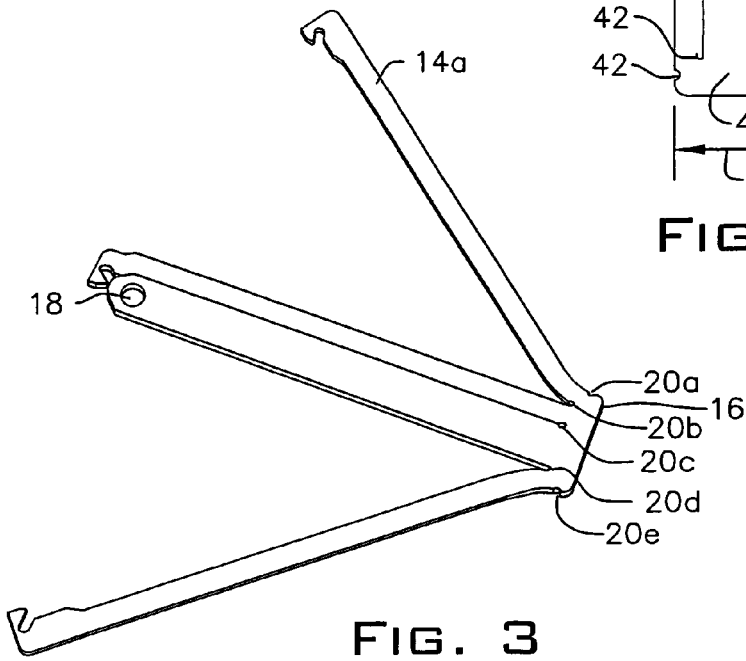
FIG. 3 is another perspective view of the grappling hook.

Referring now to the drawings, and in particular to FIGS. 1 and 3, shown therein and designated by a reference numeral 10 is a grappling hook constructed in accordance with the present invention. The grappling hook 10 is constructed of a malleable, relatively soft and bendable material such as a carbon steel alloy in the mild range, aluminum or other materials.

The grappling hook 10 can be used by the military in obstacle reduction (hooking on to barbed wire or concertina and being pulled out of place by a vehicle with the grappling hook 10 and rope, cable or chain attached). The grappling hook 10 can also be used in finding and exploding mines that use trip wires (throwing the device over an area where the known or suspected trip wire may exist). The grappling hook 10 can be used as a dragging device by fire and rescue officers in dragging a body of water for missing people or submerged missing items. The grappling hook 10 can be thrown by hand, with a rope-like attachment, or can be fired some useful longer distances using compressed air, spring tension, or explosive charges.

The grappling hook 10 offers the primary advantage of being a strong, easily storable, in its delivered form, easily manually deployable, tool for retrieving objects and has other numerous uses. It can be made in various sizes and widths. The tool can be machined from steel, aluminum, or other materials. Two main logistical or military advantages of the grappling hook 10 are the small spaces required to carry several of the grappling hooks 10 and its light weight.

As will be discussed below, the grappling hook 10 can be a relatively cheap, almost "disposable" device.

The grappling hook 10 is provided with a shaft 12, a plurality of arms 14 (labeled in FIG. 1 via the reference numerals 14*a*, 14*b* and 14*c* for purposes of clarity), and a connecting member 16. The connecting member 16 connects each of the arms 14 to the shaft 12 such that the arms 14 extend angularly from the shaft 12. The shaft 12 forms an eyelet 18 (FIG. 3) such that a rope, cable, chain or other device can be attached to the shaft 12.

The grappling hook 10 is provided with a plurality of relief cutouts 20 to promote or facilitate bending of the arms 14 relative to the connecting member 16. The relief cutouts are indicated in FIG. 3 by the reference numerals 20*a*, 20*b*, 20*c*, 20*d* and 20*e* for purposes of clarity. Generally, two cutouts 20 are provided at the intersection of each of the arms 14 and the connecting member 16. For example, the relief cutouts 20*a* and 20*b* are provided at the intersection between the connecting member 16 and the arm 14*a*. The relief cutouts 20 promote compression and tension of the arms 14 and the connecting members 16, without cracking or breaking the arms 14 or the connecting members 16. In one preferred embodiment, the shaft 12, the arms 14, and the connecting member 16 are formed as a unitary structure which has been bent to the configuration shown in FIG. 1.

The use of grappling hooks, such as the grappling hook 10, is well known in the art. Thus, a description of the use of the grappling hook 10 is not deemed necessary to teach one skilled in the art how to use the grappling hook 10.

Figure 2:
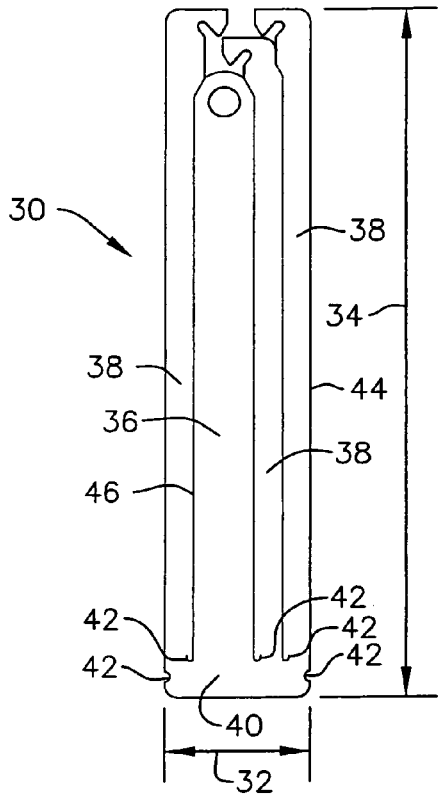
FIG. 2 is a plan view of a grappling hook blank constructed in accordance with the present invention and used in constructing the grappling hook depicted in FIG. 1.

Referring to FIG. 2, shown therein is a grappling hook blank 30 which is used in the formation of the grappling hook 10. The grappling hook blank 30 is preferably formed of a piece of flat material having malleable, yet rigid qualities such that portions of the grappling hook blank 30 can be easily bent using little manual force. For example, the grappling hook blank 30 can be constructed of a carbon steel in the mild range, aluminum or other materials. The material forming the grappling hook blank 30 preferably has a thickness in the range from ⅛ of an inch up to ½ of an inch depending on the desired application, and the material used in constructing the grappling hook blank 30.

The grappling hook blank 30 has a width 32 and a length 34. The size of the width 32 and length 34 can vary widely depending on the types of materials forming the grappling hook blank 30, as well as the intended configuration of the grappling hook 10. In one preferred embodiment, the width 32 of the grappling hook blank 30 is about 2½ inches, and the length 34 is in a range from about 12 inches to about 16 inches.

The grappling hook blank 30 defines a shaft portion 36, a plurality of arm portions 38, and a connecting member portion 40. The shaft portion 36 and the arm portions 38 are connected to the connecting member portion 40. A plurality of relief cutouts 42 are provided at the intersection of each of the arm portions 38 and the connecting member portion 40 such that the arm portions 38 can be bent or formed as will be discussed below. The grappling hook blank 30 can be provided with any number of arm portions 38 desired for the intended use. For example, the grappling hook blank 30 may be provided with 2, 3, 4 or 5 arm portions 38.

The shaft portion 36 of the grappling hook blank 30 forms the shaft 12 of the grappling hook 10. The arm portions 38 of the grappling hook blank 30 form the arms 14 of the grappling hook 10. The connecting member portion 40 of the grappling hook blank 30 forms the connecting member 16 of the grappling hook 10.

The shaft portion 36, the arm portions 38 and the connecting member portion 40 can be defined in the grappling hook blank 30 by an outer peripheral edge 44 of the grappling hook blank 30 as well as separation lines 46 formed in the grappling hook blank 30. The separation lines 46 can be formed in the grappling hook blank 30 by any machine or process capable of cutting and/or otherwise forming the separation lines 46. For example, the separation lines 46 can be formed with a laser or a plasma cutter, die cutting device, or a mill.

Because of its compact size and light weight, the grappling hook blank 30 is preferably shipped or transported to a desired location for use and then formed into the grappling hook 10. The grappling hook 10 can be formed by applying manual force to the arm portions 38 of the grappling hook blank 30 and thereby moving the arm portions 38 outwardly to form the arms 14 of the grappling hook 10.

Figure 4:
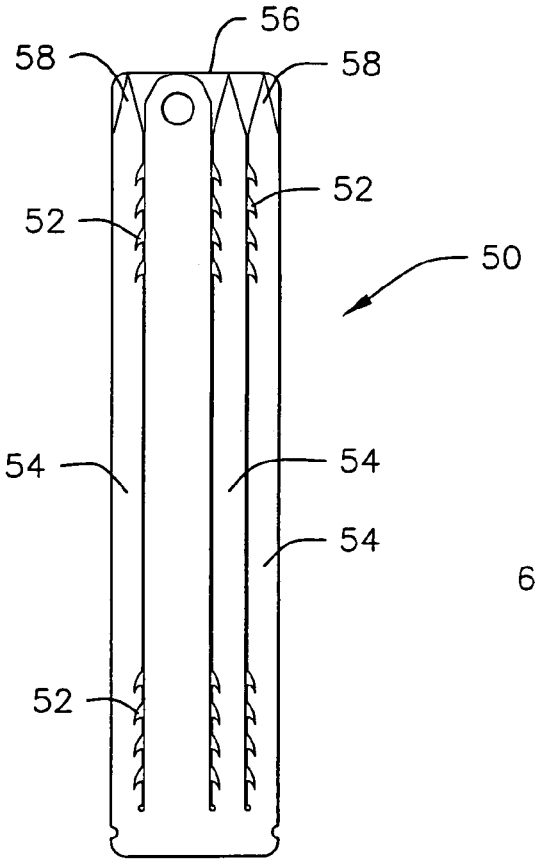
FIG. 4 is a plan view of an alternate embodiment of a grappling hook blank.
Figure 5:
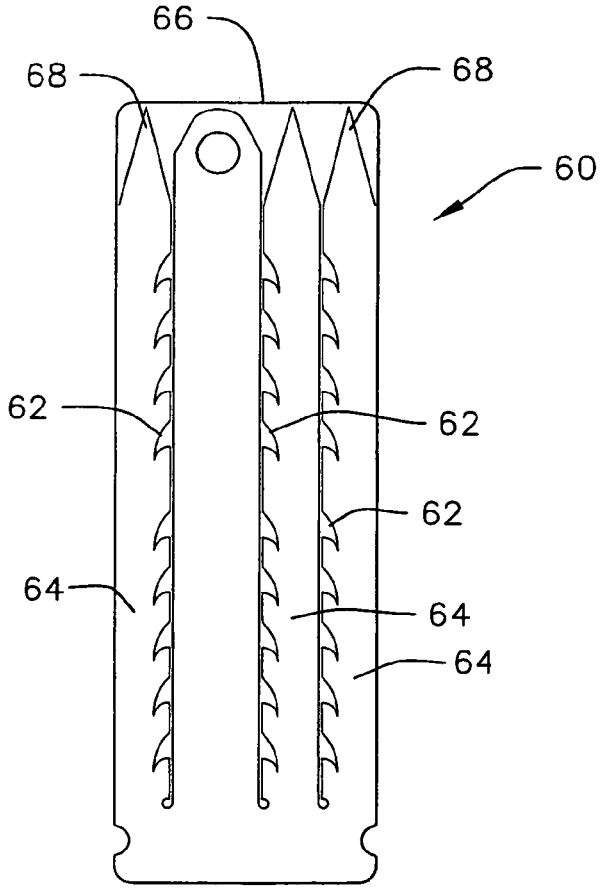
FIG. 5 is a plan view of another alternate embodiment of a grappling hook blank.

Referring now to FIGS. 4 and 5, shown are two other versions of grappling hook blanks 50 and 60, constructed in accordance with the present invention. The grappling hook blanks 50 and 60 are similar in construction and function as the grappling hook blank 30, except that the grappling hook blanks 50 and 60 are shaped to provide a plurality of hooks 52 and 62 on the arm portions 54 and 64. The hooks 52 and 62 are used to snag barbed wire and trip wires attached to explosives. Only some of the hooks 52 and 62 have been numbered for purposes of brevity. The configuration of the hooks 52 and 62 can be varied.

The grappling hook blanks 50 and 60 are each further provided with a breakaway, protective portion top 56 and 66, respectively. The break away, protective tops 56 and 66 prevent damage to the sharp points 58 and 68 of the arm portions 54 and 64, as well as prevent injury to an individual carrying the grappling hook blanks 50 and 60. The grappling hook blanks 50 and 60 may be sized to a length of about 7 inches and a width of about 2.25 inches so that the grappling hook blanks 50 and 60 will fit in an M16 ammo pouch which holds several 30-round magazines for military or police SWAT unit use.

Figure 6:
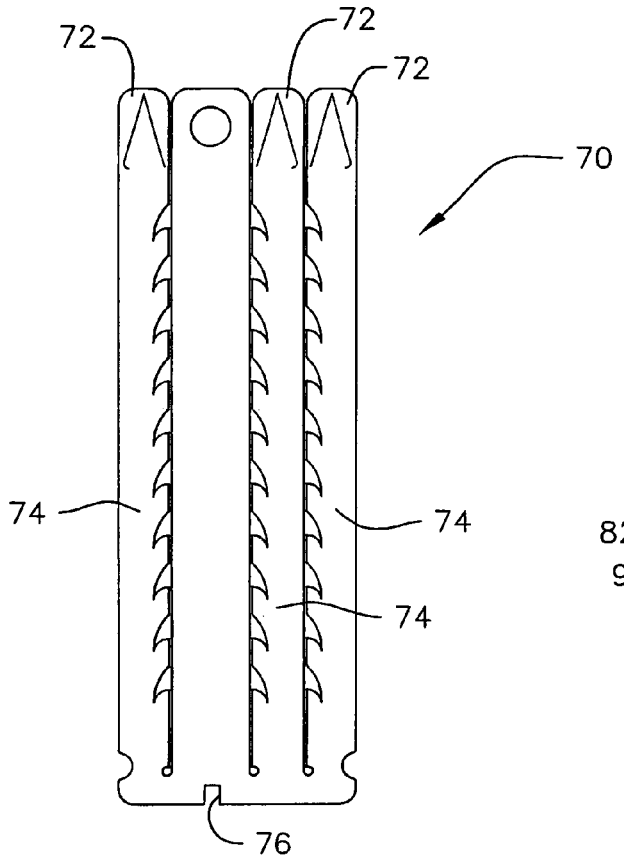
FIG. 6 is a plan view of another alternate embodiment of a grappling hook blank.

Shown in FIG. 6 is a grappling hook blank 70 constructed in accordance with the present invention. The grappling hook blank 70 is similar to the grappling hook blanks 50 and 60, except that the grappling hook blank 70 is provided with one or more breakaway tabs 72 for changing the configuration of arm portions 74. The grappling hook blank 70 is also provided with a notch 76 formed therein. The notch 76 is sized to receive a portion of one of the breakaway tabs 72 for permitting the grappling hook blank 70 to be used as a tool for removing the breakaway tabs 72 on another grappling hook blank 70. The breakaway tabs 72 can also be removed with a hand tool, such as a pair of pliers. The size of the grappling hook blank 70 can be varied. In one preferred embodiment, the grappling hook blank 70 has a length of about 7 inches and a width of about 2.25 inches so that the grappling hook blank 70 will fit in an M16 ammo pouch which holds several 30-round magazines for military or police SWAT unit use.

Figure 7:
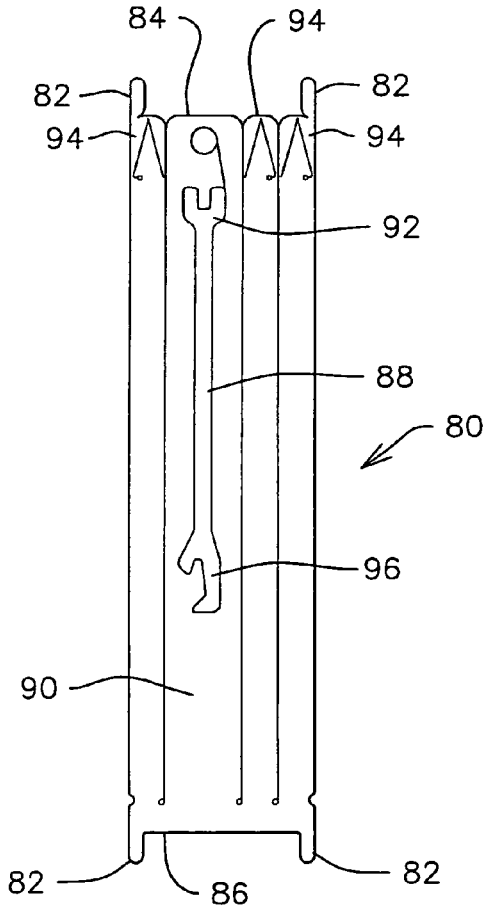
FIG. 7 is a plan view of another alternate embodiment of a grappling hook blank.

Referring to FIG. 7, another version of a grappling hook blank 80 constructed in accordance with the present invention is shown. The grappling hook blank 80 is similar to the grappling hook blank 70, except that the grappling hook 80 is provided with one or more breakaway horns 82 so as to provide storage spaces 84 and 86 for storing rope, cable, or chain by linearly wrapping the rope, cable, or chain about the grappling hook blank 80.

The grappling hook blank 80 is also provided with a break-off tool 88 formed in shaft portion 90. The break-off tool 88 may be popped out of the shaft portion 90 without the use of a hand tool. One end 92 of the break-off tool 88 is provided with a wrench for breaking off breakaway horns 82 and breakaway tabs 94. The opposite end 96 of the break-off tool 88 is shown provided with a bottle opener. However, it should be understood that any other varied implement may be placed on the opposite end 96 of the break-off tool 88, such as a screw driver, a file, or a knife.

The foregoing is considered as illustrative only of the principles of the invention. Further, since numerous modifications and changes will readily occur to those skilled in the art, it is not desired to limit the invention to the exact construction and operation shown and described above. Therefore, changes may be made in the combinations, operations, and arrangements of the various parts and elements described herein without departing from the spirit and the scope of the invention as defined in the following claims.

What is claimed is:

1. A grappling hook blank for forming a grappling hook having a shaft, a plurality of arms and a connecting member, the grappling hook blank, comprising:

a piece of material having a shaft portion, a plurality of arm portions, and a connecting member portion, the shaft portion forming the shaft of the grappling hook, the plurality of arm portions forming the plurality of arms of the grappling hook such that each of the plurality of arms of the grappling hook is formed by moving each of the plurality of arm portions outwardly from the piece of material, and the connecting member portion connecting the shaft portion and the plurality of arm portions wherein the connecting member portion forms a connecting member of the grappling hook such that the connecting member of the grappling hook connects the shaft and the plurality of arms of the grappling hook wherein a portion of the shaft portion, the plurality of arm portions, and the connecting member portion are defined by a plurality of separation lines formed in the piece of material.

2. A grappling hook blank for forming a grappling hook having a shaft, a plurality of arms and a connecting member, the grappling hook blank, comprising:

a piece of material having a shaft portion, a plurality of arm portions, and a connecting member portion, the shaft portion forming the shaft of the grappling hook, the plurality of arm portions forming the plurality of arms of the grappling hook such that each of the plurality of arms of the grappling hook is formed by moving each of the plurality of arm portions outwardly from the piece of material, and the connecting member portion connecting the shaft portion and the plurality of arm portions wherein the connecting member portion forms a connecting member of the grappling hook such that the connecting member of the grappling hook connects the shaft and the plurality of arms of the grappling hook wherein a plurality of relief cutouts are provided at an intersection of each of the plurality of arm portions and the connecting member portion.

3. A grappling hook blank for forming a grappling hook having a shaft, a plurality of arms and a connecting member, the grappling hook blank, comprising:

a piece of material having a shaft portion, a plurality of arm portions, and a connecting member portion, the shaft portion forming the shaft of the grappling hook, the plurality of arm portions forming each of the plurality of arms of the grappling hook such that each of the plurality of arms of the grappling hook is formed by moving each of the plurality of arm portions outwardly from the piece of material, and the connecting member portion connecting the shaft portion and the plurality of arm portions wherein the connecting member portion forms a connecting member of the grappling hook such that the connecting member of the grappling hook connects the shaft and the plurality of arms of the grappling hook wherein at least one breakaway tab is provided for changing the configuration of at least one of the plurality of arm portions wherein a notch is formed in the piece of material, the notch being sized to receive a portion of one of the breakaway tabs for permitting the grappling hook blank to be used as a tool for removing breakaway tabs from a different grappling hook blank.

* * * * *